US011854437B2

(12) United States Patent
Brinkerhoff

(10) Patent No.: US 11,854,437 B2
(45) Date of Patent: Dec. 26, 2023

(54) TRADE CARD PROTECTION ASSEMBLY

(71) Applicant: Justin Brinkerhoff, San Antonio, TX (US)

(72) Inventor: Justin Brinkerhoff, San Antonio, TX (US)

( * ) Notice: Subject to any disclaimer, the term of this patent is extended or adjusted under 35 U.S.C. 154(b) by 377 days.

(21) Appl. No.: 17/400,656

(22) Filed: Aug. 12, 2021

(65) Prior Publication Data

US 2023/0048029 A1 Feb. 16, 2023

(51) Int. Cl.

| | |
|---|---|
| ***B65D 85/48*** | (2006.01) |
| ***G09F 1/12*** | (2006.01) |
| ***G09F 3/18*** | (2006.01) |
| ***A47G 1/12*** | (2006.01) |
| ***A47G 1/06*** | (2006.01) |
| ***B65D 25/10*** | (2006.01) |
| ***B65D 25/54*** | (2006.01) |
| ***B65D 81/02*** | (2006.01) |
| ***B65D 55/02*** | (2006.01) |
| ***B65D 25/28*** | (2006.01) |
| ***B65D 43/16*** | (2006.01) |

(52) U.S. Cl.

CPC ..... *G09F 1/12* (2013.01); *B65D 25/107* (2013.01); *B65D 25/2858* (2013.01); *B65D 25/54* (2013.01); *B65D 43/16* (2013.01); *B65D 55/02* (2013.01); *B65D 81/022* (2013.01)

(58) Field of Classification Search

CPC ... G09F 1/10; G09F 1/12; G03B 21/54; A47F 7/163; A47F 3/14; B42F 17/02; B42F 17/22; B42F 7/12

See application file for complete search history.

(56) References Cited

U.S. PATENT DOCUMENTS

| | | | | | |
|---|---|---|---|---|---|
| 2,119,407 | A | * | 5/1938 | Weiskopf | A47B 63/02 312/308 |
| 3,180,697 | A | * | 4/1965 | Mulch | G03B 21/54 312/319.1 |
| 4,640,416 | A | * | 2/1987 | Northrup | G11B 33/0433 206/508 |
| 4,848,574 | A | * | 7/1989 | Murphy | G11B 33/0433 211/11 |
| 4,979,619 | A | | 12/1990 | Hager | |
| 5,249,383 | A | * | 10/1993 | McCusker | G09F 3/20 40/605 |

(Continued)

FOREIGN PATENT DOCUMENTS

| | | |
|---|---|---|
| WO | WO2006031225 | 3/2006 |

*Primary Examiner* — Shin H Kim

(57) ABSTRACT

A trading card protection assembly for storing trading cards for autographing includes a plurality of card frames that each receives a trading card to facilitate the trading card to be visible through the card frames. A holding panel is provided that has a receiving slot integrated into the holding panel. A respective one of the card frames is slidable into the receiving slot to facilitate the trading card in the respective card frame to be accessible for being autographed. Additionally, the holding panel has a hole extending through the holding panel to define a grip for gripping by a user to facilitate the trading card in the respective card frame to be autographed. A box is included that has a plurality of card slots for storing the card frames in an upright orientation in the box.

16 Claims, 7 Drawing Sheets

(56) References Cited

U.S. PATENT DOCUMENTS 5,344,015 A * 9/1994 Carlin ..... G09F 1/12 206/425
5,669,167 A * 9/1997 Kemp ..... G09F 1/10 40/642.02
5,878,878 A * 3/1999 Wu ..... A45D 40/22 206/307
5,979,097 A 11/1999 Moore
5,996,794 A * 12/1999 Popovich ..... G03B 21/54 206/456
6,073,764 A * 6/2000 Haas ..... G11B 33/0438 211/41.12
6,149,003 A 11/2000 Day
D469,963 S 2/2003 Jeno
7,055,690 B1 6/2006 Valdez
7,445,118 B2 11/2008 Schroeder
7,571,805 B2 8/2009 Cunningham
11,403,970 B2 * 8/2022 McEnery ..... G09F 3/185
11,605,312 B2 * 3/2023 Chiu ..... A47G 1/12
2002/0179478 A1 * 12/2002 Silvers ..... B65D 51/28 220/524
2004/0154204 A1 * 8/2004 Fu ..... G09F 3/20 40/661.01
2008/0047174 A1 * 2/2008 Lehrmitt ..... G09F 1/10 40/124.06
2009/0019738 A1 * 1/2009 Cunningham ..... B43K 23/001 40/1
2014/0227063 A1 * 8/2014 Salter ..... G09F 3/20 412/19
2016/0351081 A1 * 12/2016 Willoughby ..... A45C 11/00
2022/0114919 A1 * 4/2022 McEnery ..... A45C 11/24
2022/0144508 A1 * 5/2022 Sabin ..... A47G 1/12
2022/0254280 A1 * 8/2022 Chiu ..... G09F 3/18
2022/0270519 A1 * 8/2022 Fick ..... G09F 1/12
2023/0000227 A1 * 1/2023 Watson, Sr. ..... A45C 11/18
2023/0048773 A1 * 2/2023 Burko ..... G09F 1/10
2023/0061550 A1 * 3/2023 Newman ..... A47G 1/12
2023/0145620 A1 * 5/2023 Cummings ..... A45C 11/18 206/223

* cited by examiner

TRADE CARD PROTECTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to trading card devices and more particularly pertains to a new trading card device for storing trading cards for autographing. The device includes a plurality of card frames that can each receive a trading card for protecting the trading card. The device includes a holding panel which has a receiving slot integrated into the holding panel. A respective card frame is insertable into the receiving slot to orient the trading card to be autographed without requiring the trading card to be handled or touched. The device additionally includes a box with a plurality of card slots for storing the card frames.

(2) Description of Related Art Including Information Disclosed Under 37 CFR 1.97 and 1.98

The prior art relates to trading card devices including a variety of transparent, plastic cases for storing trading cards such that the trading cards are visible. The prior art discloses a storage box which includes a lid and a removable bottom. The prior art discloses a variety of holding frame devices for holding sports memorabilia to facilitate the sports memorabilia to be autographed while on a field of play. The prior art discloses an autograph board for holding an object to be autographed and which includes a removable cover to cover the object when the object is not being autographed.

BRIEF SUMMARY OF THE INVENTION

An embodiment of the disclosure meets the needs presented above by generally comprising a plurality of card frames that each receives a trading card to facilitate the trading card to be visible through the card frames. A holding panel is provided that has a receiving slot integrated into the holding panel. A respective one of the card frames is slidable into the receiving slot to facilitate the trading card in the respective card frame to be accessible for being autographed. Additionally, the holding panel has a hole extending through the holding panel to define a grip for gripping by a user to facilitate the trading card in the respective card frame to be autographed. A box is included that has a plurality of card slots for storing the card frames in an upright orientation in the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
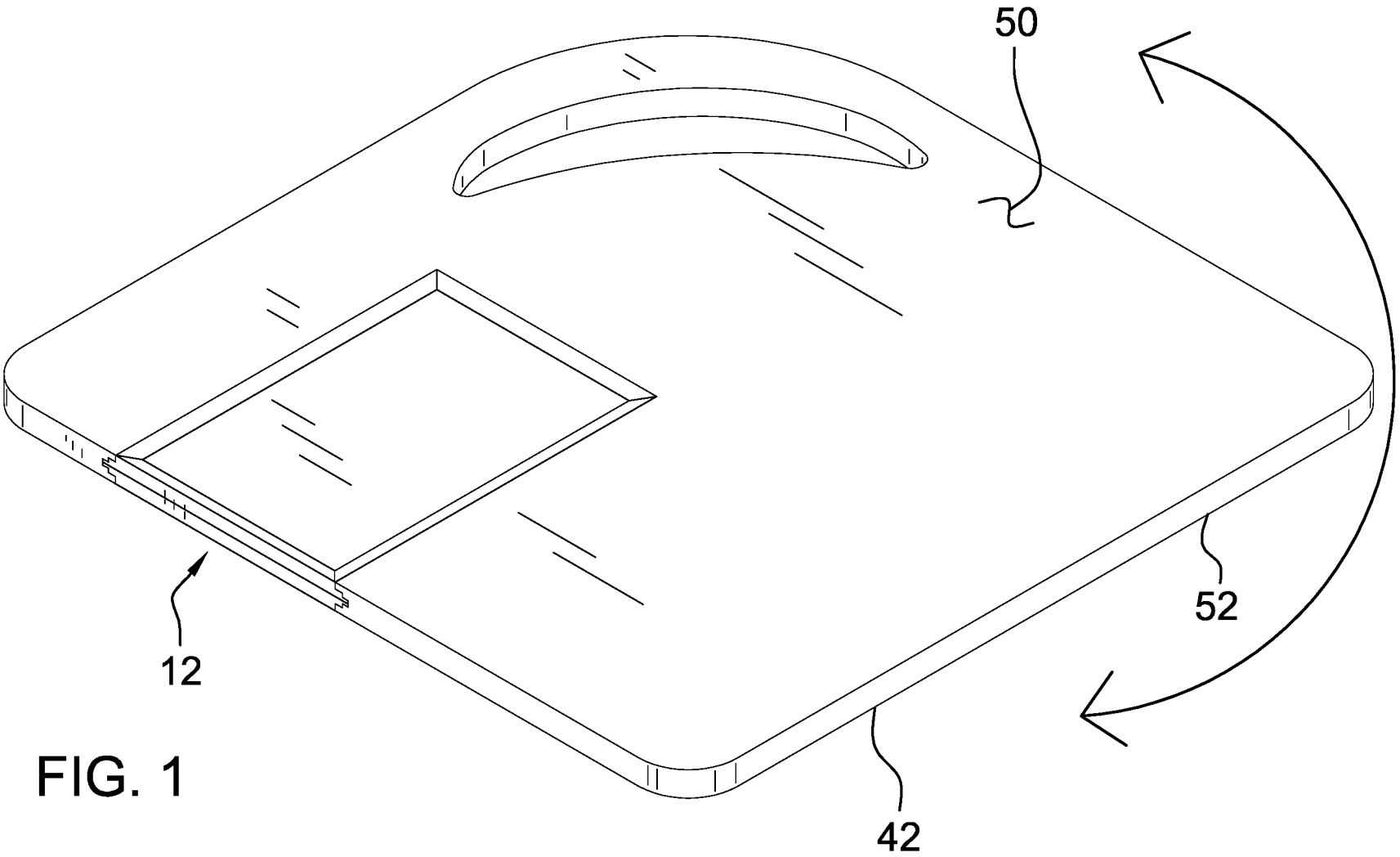
FIG. 1 is a top perspective view of a holding panel of an embodiment of the disclosure.
Figure 2:
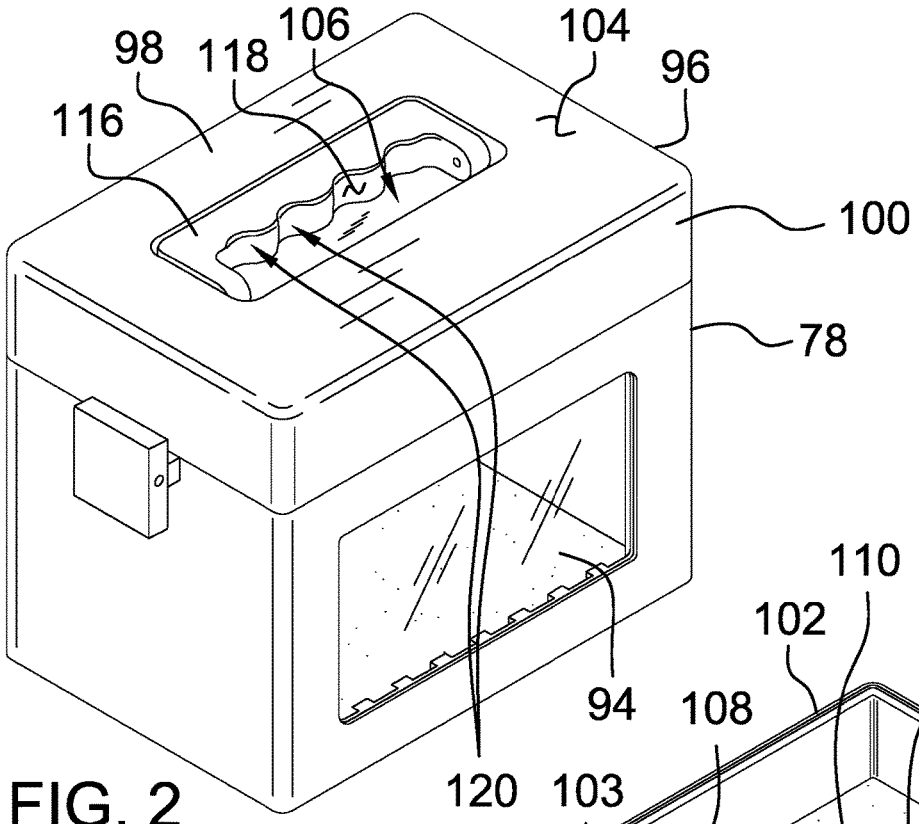
FIG. 2 is a perspective view of box of an embodiment of the disclosure.
Figure 3:
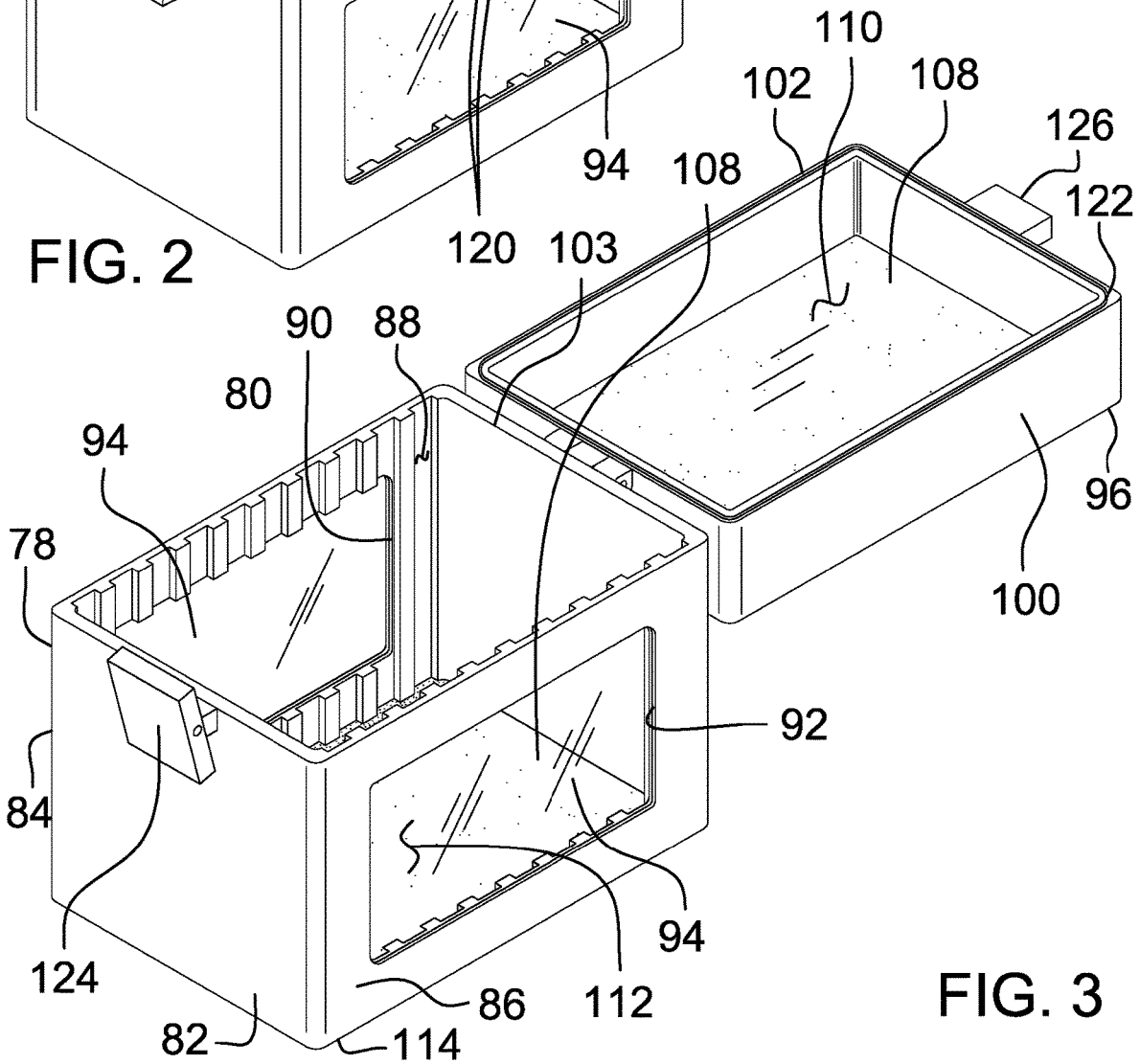
FIG. 3 is a top perspective view of box of an embodiment of the disclosure.
Figure 4:
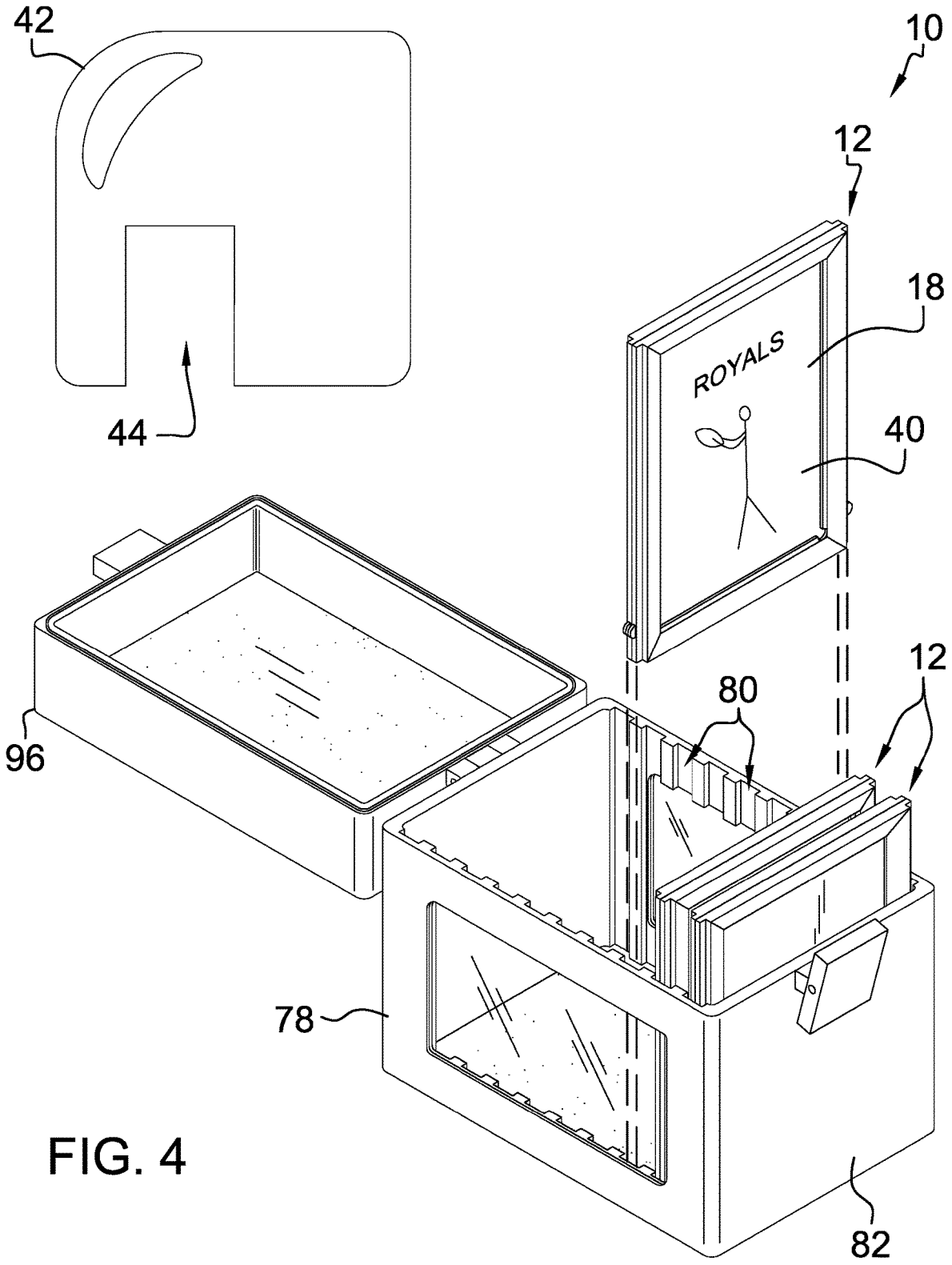
FIG. 4 is a perspective view of trading card protection assembly according to embodiment of the disclosure.
Figure 5:
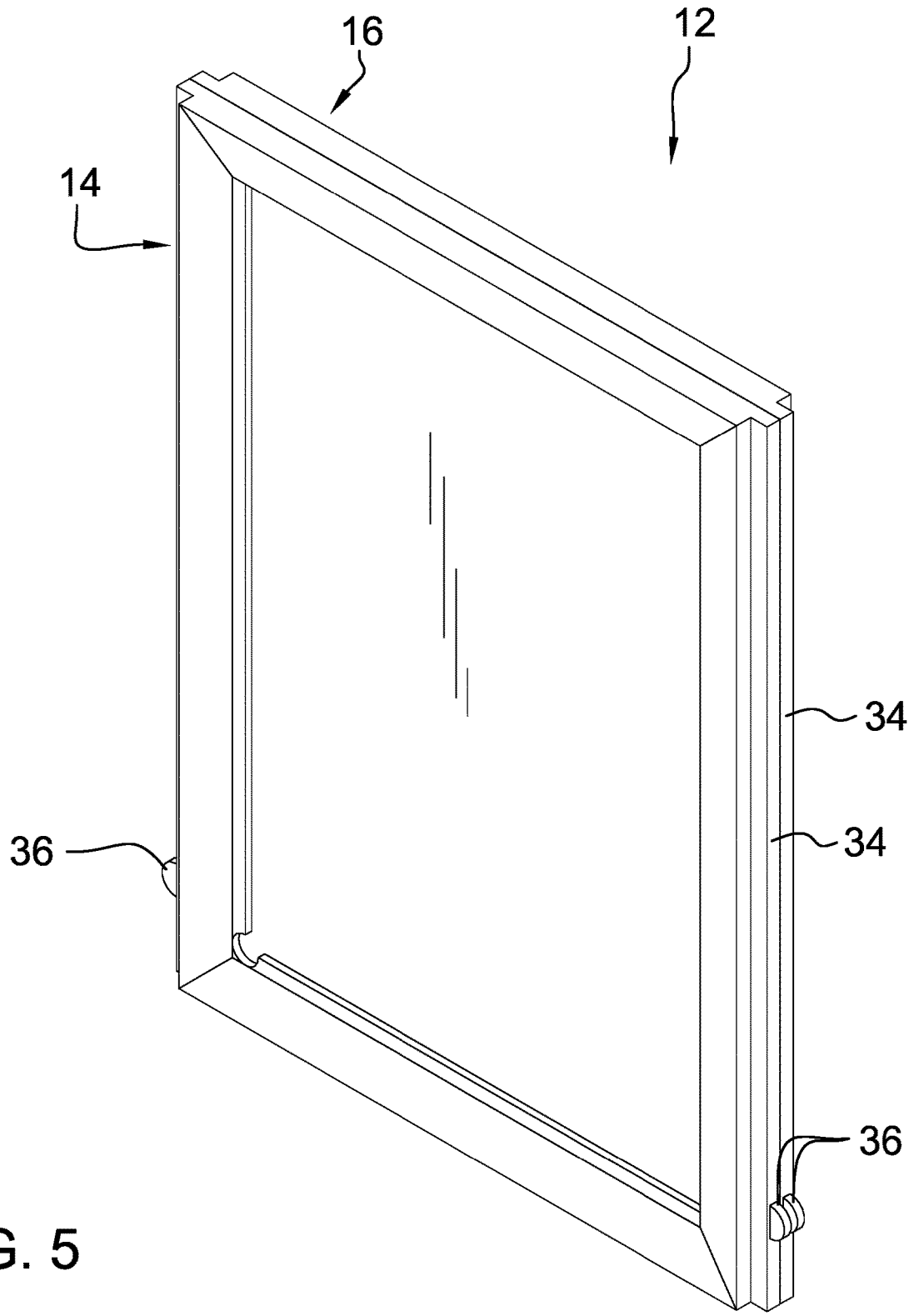
FIG. 5 is a front perspective view of a card frame of an embodiment of the disclosure.
Figure 6:
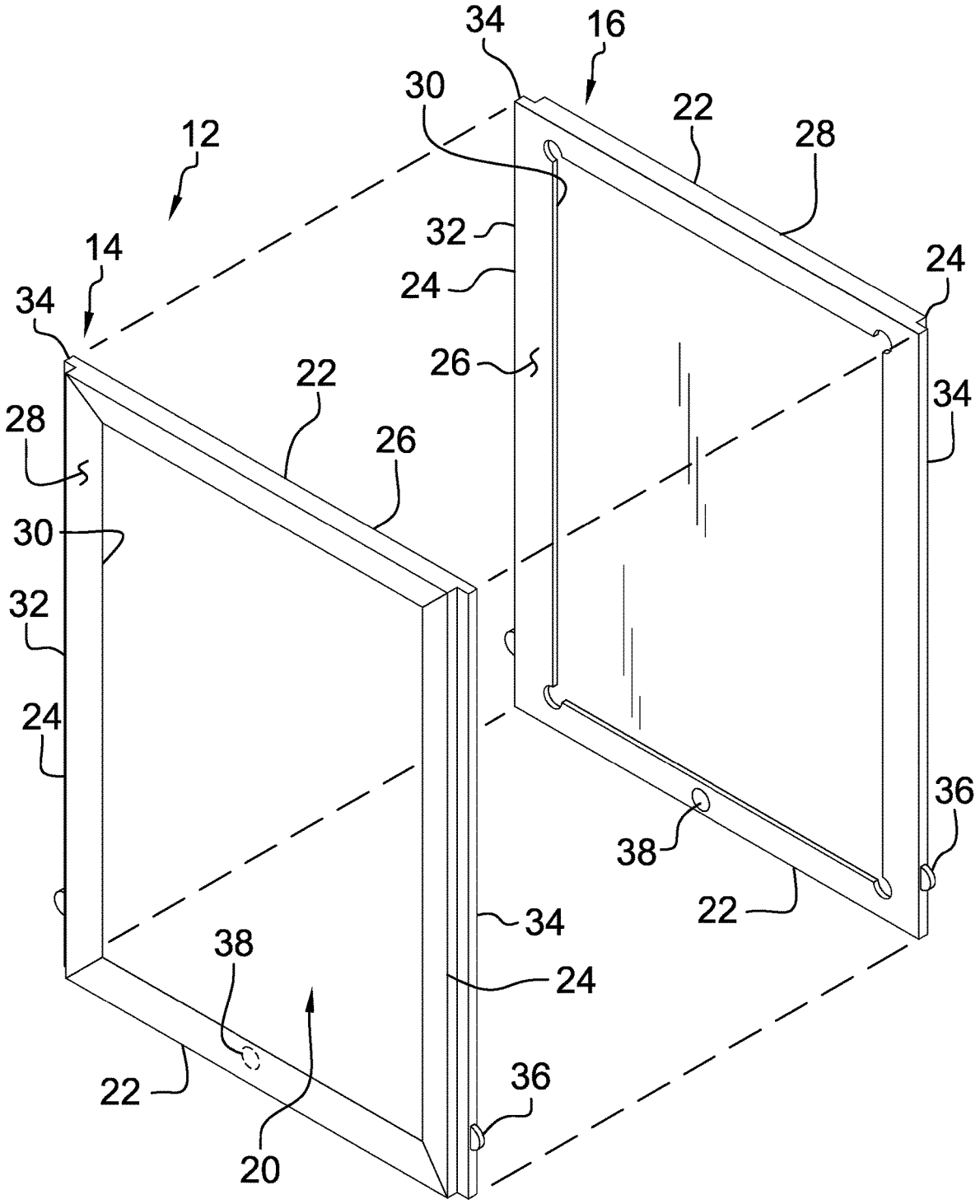
FIG. 6 is an explode perspective view of a card frame of an embodiment of the disclosure.
Figure 7:
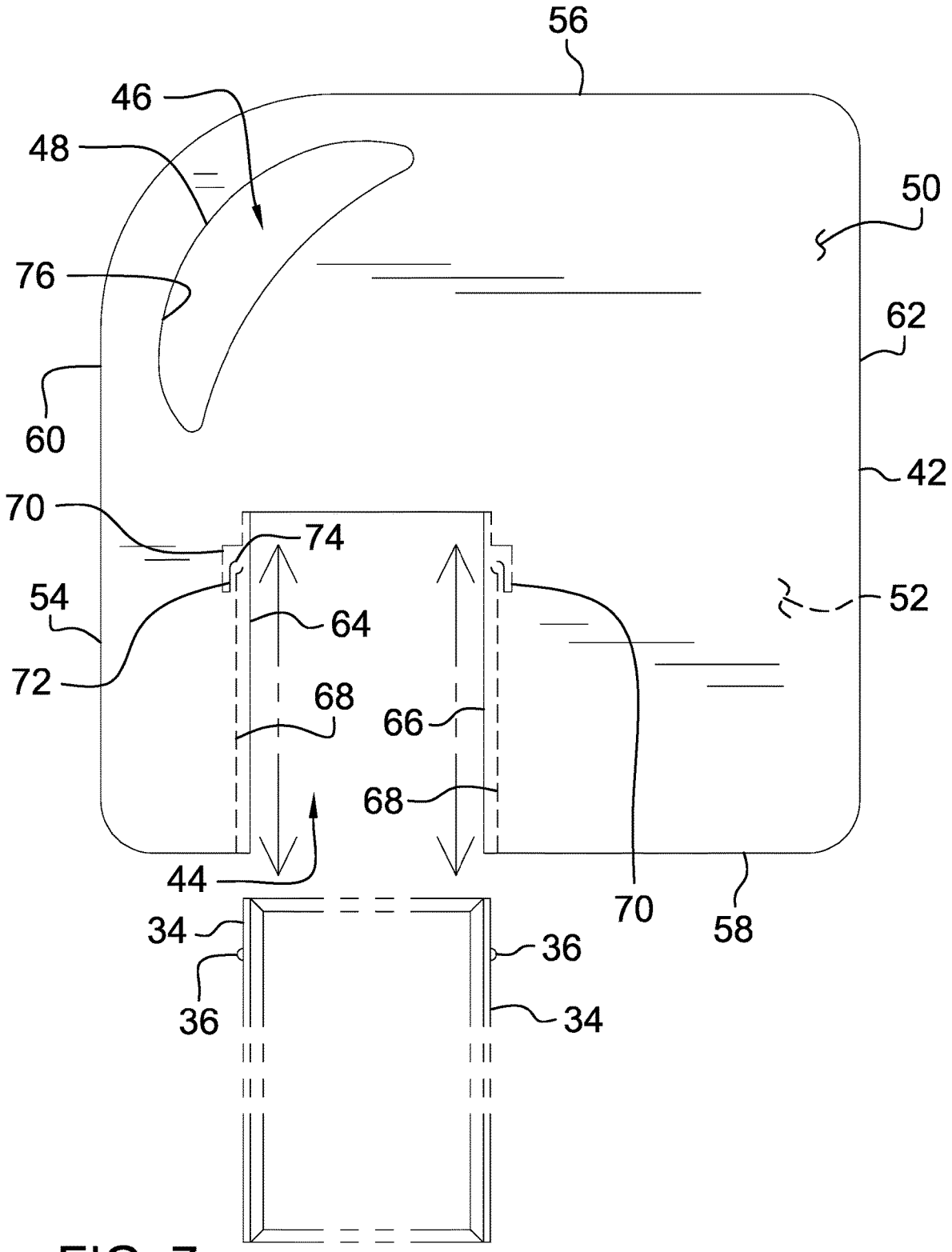
FIG. 7 is an exploded perspective view of a card frame and a holding panel of an embodiment of the disclosure.
Figure 8:
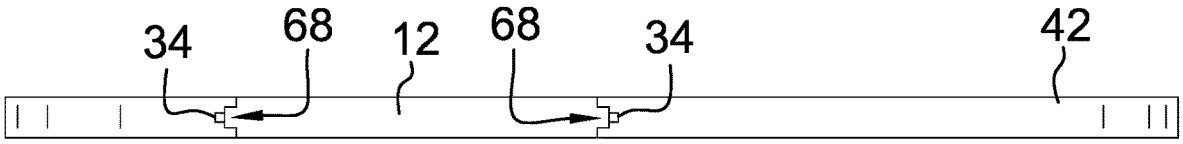
FIG. 8 is a front view of a card frame being inserted into a receiving slot in a holding panel of an embodiment of the disclosure.
Figure 9:
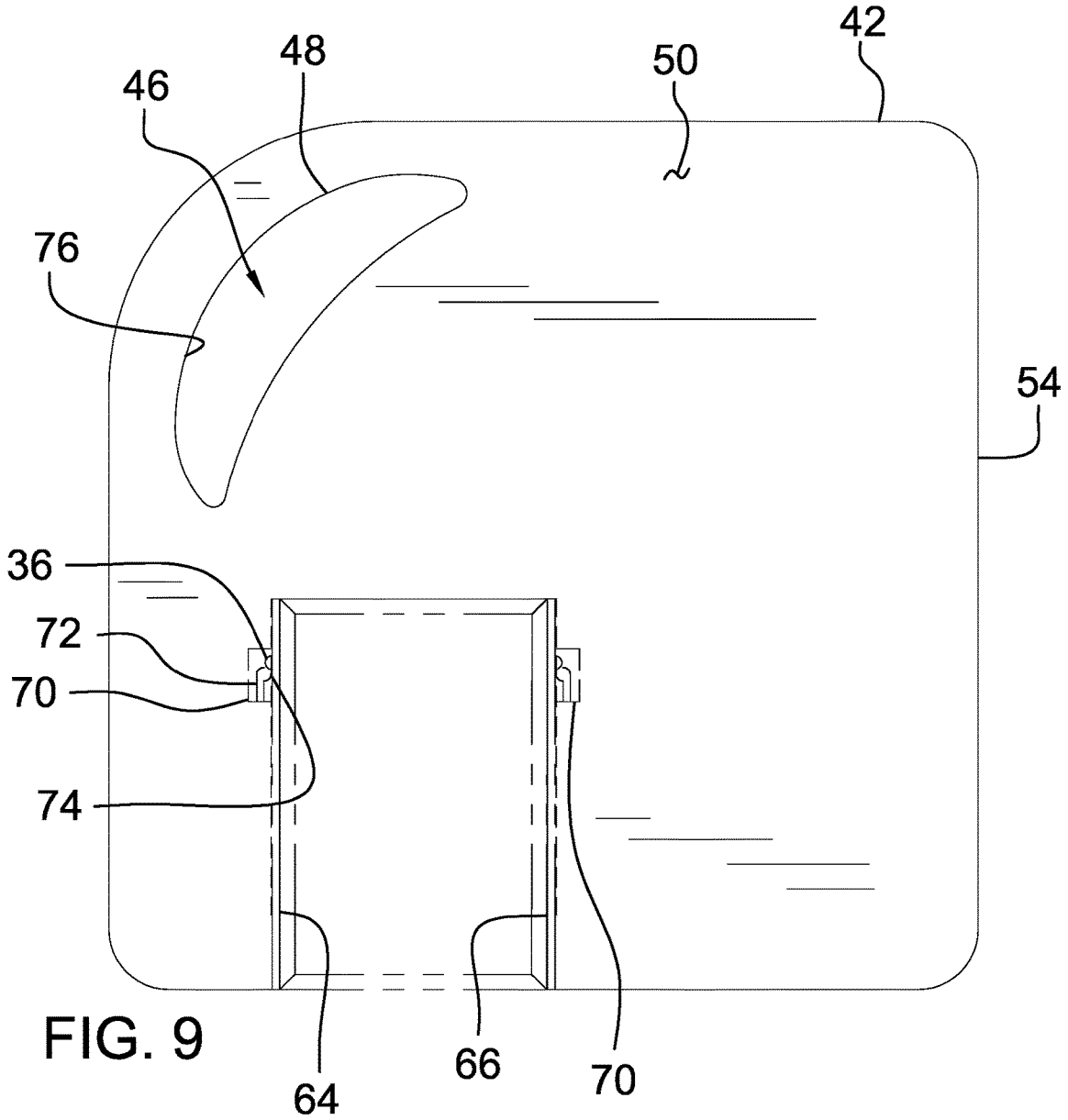
FIG. 9 is a top view of a card frame being inserted into a receiving slot in a holding panel of an embodiment of the disclosure.

With reference now to the drawings, and in particular to FIGS. 1 through 9 thereof, a new trading card device embodying the principles and concepts of an embodiment of the disclosure and generally designated by the reference numeral 10 will be described.

As best illustrated in FIGS. 1 through 9, the trading card protection assembly 10 generally comprises a plurality of card frames 12 that each comprises a first half 14 which releasably engages a second half 16 to compress a trading card 18 between the first half 14 and the second half 16. The trading card 18 may be baseball card, a football card or any other type of trading card that is commonly collected and which increases in value based upon the condition of the trading card 18. The first half 14 defines an opening 20 to facilitate the trading card 18 to be visible through the opening 20. Each of the first half 14 and the second half 16 comprises a pair of first arms 22 extending between a pair of second arms 24. Additionally, each of the first arms 22 and the second arms 24 intersect at a right angle such that each of the first half 14 and the second half 16 has a rectangular shape.

Each of the first arms 22 and the second arms 24 has a first surface 26, a second surface 28, an inwardly facing edge 30 and an outwardly facing edge 32. The inwardly facing edge 30 of each of the first arms 22 and the second arms 24 defines the opening 20 in the first half 14. Additionally, the second half 16 has a panel extending between each of the first arms 22 and each of the second arms 24. The panel is aligned with the second surface 28 of each of the first arms 22 and the second arms 24 of the second half 16. The first surface 26 of each of the first arms 22 and the second arms 24 of the first half 14 abuts the first surface 26 of respective first arms 22 and respective second arms 24 of the second half 16 when the first half 14 engages the second half 16.

The second surface 28 of each of the first arms 22 and each of the second arms 24 of each of the first half 14 and the second half 16 slopes inwardly between the outwardly facing edge 32 and the inwardly facing edge 30. Furthermore, the outwardly facing edge 32 of each of the second arms 24 associated with each of the first half 14 and the second half 16 has a tongue 34 extending outwardly from the outwardly facing edge 32, and the tongue 34 extends along a full length of the outwardly facing edge 32. An intersection between the inwardly facing edge 30 of each of the first arms 22 and the second arms 24 associated with the first half 14 is rounded inwardly toward the outwardly facing edge 32 of the first arms 22 and the second arms 24 associated with the first half 14. The tongue 34 on the outwardly facing edge 32 of each of the second arms 24 associated with each of the first half 14 and the second half 16 has a knob 36 extending outwardly from the tongue 34 and the knob 36 is positioned adjacent to a respective one of the first arms 22.

A plurality of magnets 38 is each integrated into a respective first half 14 and second half 16 of a respective one of the card frames 12. Each of the magnets 38 in the first half 14 and the second half 16 of each of the card frames 12 magnetically engages each other for retaining the first half 14 and the second half 16 of each of the card frames 12 together. In this way each of the card frames 12 is configured to retain the trading card 18 therein having a front face 40 of the trading card 18 being visible through the opening 20 in the first half 14. Each of the magnets 38 is recessed into the first surface 26 of a respective one of the first arms 22 of a respective one of the first half 14 and the second half 16 of a respective one of the card frames 12.

A holding panel 42 has a receiving slot 44 that is integrated into the holding panel 42 and a respective one of the card frames 12 is slidable into the receiving slot 44. In this way the card frame 12 that is inserted into the receiving slot 44 facilitates the trading card 18 in the respective card frame 12 to be accessible for being autographed. The holding panel 42 has a hole 46 extending through the holding panel 42 to define a grip 48 which can be gripped by a user to facilitate the trading card 18 in the respective card frame 12 to be autographed. In this way the trading card 18 does not have to be held or touched while the trading card 18 is being autographed for preserving the condition of the trading card 18.

The holding panel 42 has a top surface 50, a bottom surface 52 and a perimeter edge 54 extending between the top surface 50 and the bottom surface 52, and the perimeter edge 54 has a top side 56, a bottom side 58, a first lateral side 60 and a second lateral side 62. An intersection between the first lateral side 60 and the top side 56 is rounded. The receiving slot 44 extends from the bottom side 58 toward the top side 56 and the receiving slot 44 is positioned closer to the first lateral side 60 than the second lateral side 62. Furthermore, the receiving slot 44 has a first lateral bounding edge 64 and a second lateral bounding edge 66, and each of the first lateral bounding edge 64 and the second lateral bounding edge 66 has a groove 68 that is integrated therein. The groove 68 in each of the first lateral bounding edge 64 and the second lateral bounding edge 66 receives the tongue 34 on the outwardly facing edge 32 of a respective one of the second arms 24 of the respective card frame 12 that is inserted into the receiving slot 44.

Each of the first lateral bounding edge 64 and the second lateral bounding edge 66 has a recess 70 extending into the holding panel 42. Moreover, the recess 70 in each of the first lateral bounding edge 64 and the second lateral bounding edge 66 intersects the groove 68 in a respective first lateral bounding edge 64 and the second lateral bounding edge 66. The recess 70 in each of the first lateral bounding edge 64 and the second lateral bounding edge 66 has a lock 72 that is movably integrated into the recess 70. Furthermore, the lock 72 has a lobe 74 extending toward the receiving slot 44 and the lock 72 is biased to extend toward the receiving slot 44. The knob 36 on the tongue 34 of each of the second arms 24 of the first half 14 and the second half 16 of the respective card frame 12 that is inserted into the receiving slot 44 urges the lobe 74 away from the receiving slot 44 when the respective card frame 12 is inserted into the receiving slot 44 until the knob 36 passes beyond the lobe 74. In this way the lobe 74 releasably retains the respective card frame 12 in the receiving slot 44.

The hole 46 in the holding panel 42 extends through the top surface 50 and the bottom surface 52, and the hole 46 has a bounding edge 76. The bounding edge 76 of the hole 46 traces an undulating path such that the hole 46 has a crescent shape. The hole 46 is positioned adjacent to the intersection between the first lateral side 60 and the top side 56 of the perimeter edge 54 of the holding panel 42 such that a respective side of the bounding edge 76 of the hole 46 is co-arcuate with the intersection between the first lateral side 60 and the top side 56.

A box 78 is provided that has a plurality of card slots 80 each is integrated into opposing walls of the box 78. Each of the card frames 12 is insertable into a respective pair of the card slots 80 for storing the card frames 12 in an upright orientation in the box 78. Additionally, each of the card frames 12 has a height that is greater that the height of the box 78 such that each of the card frames 12 extends outwardly from the box 78 to enhance removing the card frames 12 from the box 78. The box 78 has an outer wall 82 and the outer wall 82 has a first sidelong side 84 and a second sidelong side 86. Each of the first sidelong side 84 and side and the second sidelong side 86 has an interior surface 88, and each of the card slots 80 is recessed into the interior surface 88 of a respective one of the first sidelong side 84 and the second sidelong side 86.

The card slots 80 in each of the first sidelong side 84 are aligned with a respective one of the card slots 80 in the second sidelong side 86. The card slots 80 in each of the first sidelong side 84 and the second sidelong side 86 are spaced apart from each other and are distributed along a full length of the first sidelong side 84 and the second sidelong side 86. The first sidelong side 84 has a first opening 90 extending through the first sidelong side 84 thereby facilitating an interior of the box 78 to be visible through the first opening 90. Additionally, the second sidelong has a second opening 92 extending through the second sidelong side 86 thereby facilitating the interior of the box 78 to be visible through the second opening 92.

A pair of windows 94 is each integrated into a respective first sidelong side 84 and the second sidelong side 86 of the outer wall 82 of the box 78. Each of the windows 94 is aligned with a respective one of the first opening 90 and the second opening 92. Additionally, each of the windows 94 is comprised of a translucent material thereby facilitating the interior of the box 78 to be visible through the windows 94. A lid 96 is hingedly coupled to the box 78 for opening 20 and closing the box 78. The lid 96 has a top wall 98 and a perimeter wall 100 extending downwardly from the top wall 98, and the perimeter wall 100 has a distal edge 102 with respect to the top wall 98. The distal edge 102 rests on a top edge 103 of the outer wall 82 of the box 78 when the lid 96 is closed. Furthermore, a top surface 104 of the top wall 98 has a recess 106 extending downwardly in the top surface 50.

A pair of cushions 108 is each coupled to a respective lower surface 110 of the top wall 98 of the lid 96 and a top surface 112 of a bottom wall 114 of the box 78. Each of the cushions 108 is comprised of a resiliently compressible material for cushioning the card frames 12 when the card frames 12 are stored in the box 78. A handle 116 is movably integrated into the recess 106 in the top wall 98 of the lid 96 and the handle 116 is positionable in a stored position having the handle 116 lying in the recess 106 in the top wall of the lid 96. Conversely, the handle 116 is positionable in a deployed position having the handle 116 extending upwardly from the recess 70 thereby facilitating the handle 116 to be gripped for carrying the box 78. The handle 116 has a gripping surface 118 and the gripping surface 118 has a plurality of depressions 120 integrated into the gripping surface 118 accommodate a user's fingers for enhancing gripping the handle 116.

A gasket 122 is coupled to the distal edge 102 of the perimeter wall 100 of the lid 96 and the gasket 122 forms a seal with the top edge 103 of the outer wall 82 of the box 78 when the lid 96 is closed. In this way the gasket 122 inhibits moisture from entering the box 78 when the lid 96 is closed which could potentially damage the trading cards 18 that are positioned in each of the card frames 12. A latch 124 is hingedly coupled to the outer wall 82 of the box 78 and the latch 124 engages an engagement 126 on the perimeter wall 100 of the lid 96 when the lid 96 is closed for locking the lid 96. Conversely, the latch 124 is releasable from the engagement for opening the lid 96.

In use, a trading card 18 is positioned between the first half 14 and the second half 16 of a respective one of the card frames 12 such that the front face 40 of the trading card 18 is visible through the opening 20 in the first half 14 of the respective card frame 12. The respective card frame 12 is inserted into the receiving slot 44 in the holding panel 42 when the trading card 18 is to be autographed. In this way the trading card 18 does not have to be handled or touched when the trading card 18 is being autographed. Thus, the trading card 18 can be retained in pristine condition during and after the autographing process. Each of the card frames 12 can be stored in the box 78 to preserve the condition of the trading cards 18 during transportation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trading card protection assembly for orienting a trading card for obtaining an autograph and subsequently storing the trading card, said assembly comprising:

a plurality of card frames, each of said card frames comprising a first half which releasably engages a second half wherein each of said first half and said second half of each of said card frames is configured to compress a trading card between said first half and said second half, said first half defining an opening wherein said opening is configured to facilitate the trading card to be visible through said opening;

a plurality of magnets, each of said magnets being integrated into a respective first half and second half of a respective one of said card frames, each of said magnets in said first half and said second half of each of said card frames magnetically engaging each other for retaining said first half and said second half of each of said card frames together wherein each of said card frames is configured to retain the trading card therein having a face of the trading card being visible through said opening in said first half;

a holding panel having a receiving slot being integrated into said holding panel, a respective one of said card frames being slidable into said receiving slot wherein said card frame inserted into said receiving slot is configured to facilitate the trading card in said respective card frame to be accessible for being autographed, said holding panel having a hole extending through said holding panel to define a grip wherein said grip is configured to be gripped by a user to facilitate the trading card in said respective card frame to be autographed; and a box having a plurality of card slots each being integrated into opposing walls of said box, each of said card frames being insertable into a respective pair of said card slots for storing said card frames in an upright orientation in said box.

2. The assembly according to claim 1, wherein:

each of said first half and said second half comprises a pair of first arms extending between a pair of second arms, each of said first arms and said second arms intersecting at a right angle such that each of said first half and said second half has a rectangular shape, each of said first arms and said second arms having a first surface, a second surface, an inwardly facing edge and an outwardly facing edge, said inwardly facing edge of each of said first arms and said second arms defining said opening in said first half, said second half having a panel extending between each of said first arms and each of said second arms, said panel being aligned with said second surface of each of said first arms and said second arms of said second half;

said first surface of each of said first arms and said second arms of said first half abuts said first surface of respective first arms and respective second arms of said second half when said first half engages said second half; and said second surface of each of said first arms and each of said second arms of each of said first half and said second half slopes inwardly between said outwardly facing edge and said inwardly facing edge.

3. The assembly according to claim 2, wherein:

said outwardly facing edge of each of said second arms associated with each of said first half and said second half has a tongue extending outwardly from said outwardly facing edge, said tongue extending along a full length of said outwardly facing edge; and said tongue on said outwardly facing edge of each of said second arms associated with each of said first half and said second half having a knob extending outwardly from said tongue, said knob being positioned adjacent to a respective one of said first arms.

4. The assembly according to claim 2, wherein an intersection between said inwardly facing edge of each of said first arms and said second arms associated with said first half is rounded inwardly toward said outwardly facing edge of said first arms and said second arms associated with said first half.

5. The assembly according to claim 1, wherein:

an outwardly facing edge of each of said second arms associated with each of said first half and said second half has a tongue extending outwardly from said outwardly facing edge, said tongue extending along a full length of said outwardly facing edge;

said holding panel has a top surface, a bottom surface and a perimeter edge extending between said top surface and said bottom surface, said perimeter edge having a top side, a bottom side, a first lateral side and a second lateral side, an intersection between said first lateral side and said top side being rounded, said receiving slot extending from said bottom side toward said top side, said receiving slot being positioned closer to said first lateral side than said second lateral side; and said receiving slot has a first lateral bounding edge and a second lateral bounding edge, each of said first lateral bounding edge and said second lateral bounding edge having a groove being integrated therein, said groove in each of said first lateral bounding edge and said second lateral bounding edge receiving said tongue on said outwardly facing edge of a respective one of said second arms of said respective card frame that is inserted into said receiving slot.

6. The assembly according to claim 5, wherein each of said first lateral bounding edge and said second lateral bounding edge has a recess extending into said holding panel, said recess in each of said first lateral bounding edge and said second lateral bounding edge intersecting said groove in a respective first lateral bounding edge and said second lateral bounding edge, said recess in each of said first lateral bounding edge and said second lateral bounding edge having a lock being movably integrated into said recess, said lock having a lobe extending toward said receiving slot, said lock being biased to extend toward said receiving slot.

7. The assembly according to claim 6, wherein:

an outwardly facing edge of each of said second arms associated with each of said first half and said second half has a tongue extending outwardly from said outwardly facing edge, said tongue extending along a full length of said outwardly facing edge;

said tongue on said outwardly facing edge of each of said second arms associated with each of said first half and said second half having a knob extending outwardly from said tongue, said knob being positioned adjacent to a respective one of said first arms;

said knob on said tongue of each of said second arms of said first half and said second half of said respective card frame that is inserted into said receiving slot urges said lobe away from said receiving slot when said respective card frame is inserted into said receiving slot until said knob passes beyond said lobe such that said lobe releasably retains said respective card frame in said receiving slot.

8. The assembly according to claim 1, wherein said holding panel has a top surface, a bottom surface and a perimeter edge extending between said top surface and said bottom surface, said perimeter edge having a first lateral side, a second lateral side, a top side and a bottom side, said hole in said holding panel extending through said top surface and said bottom surface, said hole having a bounding edge, said bounding edge of said hole tracing an undulating path such that said hole has a crescent shape, said hole being positioned adjacent to said intersection between said first lateral side and said top side of said perimeter edge of said holding panel such that a respective side of said bounding edge of said hole is co-arcuate with an intersection between said first lateral side and said top side.

9. The assembly according to claim 1, wherein said box has an outer wall, said outer wall having a first sidelong side and a second sidelong side, each of said first sidelong side and side and said second sidelong side having an interior surface, each of said card slots being recessed into said interior surface of a respective one of said first sidelong side and said second sidelong side, said card slots in each of said first sidelong side being aligned with a respective one of said card slots in said second sidelong side, said card slots in each of said first sidelong side and said second sidelong side being spaced apart from each other and being distributed along a full length of said first sidelong side and said second sidelong side.

10. The assembly according to claim 9, wherein:

said first sidelong side has a first opening extending through said first sidelong side thereby facilitating an interior of said box to be visible through said first opening, said second sidelong having a second opening extending through said second sidelong side thereby facilitating said interior of said box to be visible through said second opening; and a pair of windows, each of said windows being integrated into a respective first sidelong side and said second sidelong side of said outer wall of said box, each of said windows being aligned with a respective one of said first opening and said second opening, each of said windows being comprised of a translucent material thereby facilitating said interior of said box to be visible through said windows.

11. The assembly according to claim 10, further comprising a lid being hingedly coupled to said box for opening and closing said box, said lid having a top wall and a perimeter wall extending downwardly from said top wall, said perimeter wall having a distal edge with respect to said top wall, said distal edge resting on a top edge of said outer wall of said box when said lid is closed, a top surface of said top wall having a recess extending downwardly in said top surface.

12. The assembly according to claim 11, further comprising a pair of cushions, each of said cushions being coupled to a respective lower surface of said top wall of said lid and a top surface of a bottom wall of said box, each of said cushions being comprised of a resiliently compressible material for cushioning said card frames when said card frames are stored in said box.

13. The assembly according to claim 11, further comprising a handle being movably integrated into said recess, said handle being positionable in a stored position having said handle lying in said recess, said handle being positionable in a deployed position having said handle extending upwardly from said recess wherein said handle is configured to be gripped for carrying said box, said handle having a gripping surface, said gripping surface having a plurality of depressions being integrated into said gripping surface wherein each of said depressions is configured to accommodate a user's fingers for enhancing gripping said handle.

14. The assembly according to claim 11, further comprising a gasket being coupled to said distal edge of said perimeter wall of said lid, said gasket forming a seal with said top edge of said outer wall of said box when said lid is closed.

15. The assembly according to claim 11, further comprising a latch being hingedly coupled to said outer wall of said box, said latch engaging an engagement on said perimeter wall of said lid when said lid is closed for locking said lid, said latch being releasable from said engagement for opening said lid.

16. A trading card protection assembly for orienting a trading card for obtaining an autograph and subsequently storing the trading card, said assembly comprising:

a plurality of card frames, each of said card frames comprising a first half which releasably engages a second half wherein each of said first half and said second half of each of said card frames is configured to compress a trading card between said first half and said second half, said first half defining an opening wherein said opening is configured to facilitate the trading card to be visible through said opening, each of said first half and said second half comprising a pair of first arms extending between a pair of second arms, each of said first arms and said second arms intersecting at a right angle such that each of said first half and said second half has a rectangular shape, each of said first arms and said second arms having a first surface, a second surface, an inwardly facing edge and an outwardly facing edge, said inwardly facing edge of each of said first arms and said second arms defining said opening in said first half, said second half having a panel extending between each of said first arms and each of said second arms, said panel being aligned with said second surface of each of said first arms and said second arms of said second half, said first surface of each of said first arms and said second arms of said first half abutting said first surface of respective first arms and respective second arms of said second half when said first half engages said second half, said second surface of each of said first arms and each of said second arms of each of said first half and said second half sloping inwardly between said outwardly facing edge and said inwardly facing edge, said outwardly facing edge of each of said second arms associated with each of said first half and said second half having a tongue extending outwardly from said outwardly facing edge, said tongue extending along a full length of said outwardly facing edge, an intersection between said inwardly facing edge of each of said first arms and said second arms associated with said first half being rounded inwardly toward said outwardly facing edge of said first arms and said second arms associated with said first half, said tongue on said outwardly facing edge of each of said second arms associated with each of said first half and said second half having a knob extending outwardly from said tongue, said knob being positioned adjacent to a respective one of said first arms;

a plurality of magnets, each of said magnets being integrated into a respective first half and second half of a respective one of said card frames, each of said magnets in said first half and said second half of each of said card frames magnetically engaging each other for retaining said first half and said second half of each of said card frames together wherein each of said card frames is configured to retain the trading card therein having a face of the trading card being visible through said opening in said first half, each of said magnets being recessed into said first surface of a respective one of said first arms of a respective one of said first half and said second half of a respective one of said card frames;

a holding panel having a receiving slot being integrated into said holding panel, a respective one of said card frames being slidable into said receiving slot wherein said card frame inserted into said receiving slot is configured to facilitate the trading card in said respective card frame to be accessible for being autographed, said holding panel having a hole extending through said holding panel to define a grip wherein said grip is configured to be gripped by a user to facilitate the trading card in said respective card frame to be autographed, said holding panel having a top surface, a bottom surface and a perimeter edge extending between said top surface and said bottom surface, said perimeter edge having a top side, a bottom side, a first lateral side and a second lateral side, an intersection between said first lateral side and said top side being rounded, said receiving slot extending from said bottom side toward said top side, said receiving slot being positioned closer to said first lateral side than said second lateral side, said receiving slot having a first lateral bounding edge and a second lateral bounding edge, each of said first lateral bounding edge and said second lateral bounding edge having a groove being integrated therein, said groove in each of said first lateral bounding edge and said second lateral bounding edge receiving said tongue on said outwardly facing edge of a respective one of said second arms of said respective card frame that is inserted into said receiving slot, each of said first lateral bounding edge and said second lateral bounding edge having a recess extending into said holding panel, said recess in each of said first lateral bounding edge and said second lateral bounding edge intersecting said groove in a respective first lateral bounding edge and said second lateral bounding edge, said recess in each of said first lateral bounding edge and said second lateral bounding edge having a lock being movably integrated into said recess, said lock having a lobe extending toward said receiving slot, said lock being biased to extend toward said receiving slot, said knob on said tongue of each of said second arms of said first half and said second half of said respective card frame being inserted into said receiving slot urging said lobe away from said receiving slot when said respective card frame is inserted into said receiving slot until said knob passes beyond said lobe such that said lobe releasably retains said respective card frame in said receiving slot, said hole in said holding panel extending through said top surface and said bottom surface, said hole having a bounding edge, said bounding edge of said hole tracing an undulating path such that said hole has a crescent shape, said hole being positioned adjacent to said intersection between said first lateral side and said top side of said perimeter edge of said holding panel such that a respective side of said bounding edge of said hole is co-arcuate with said intersection between said first lateral side and said top side;

a box having a plurality of card slots each being integrated into opposing walls of said box, each of said card frames being insertable into a respective pair of said card slots for storing said card frames in an upright orientation in said box, said box having a outer wall, said outer wall having a first sidelong side and a second sidelong side, each of said first sidelong side and side and said second sidelong side having an interior surface, each of said card slots being recessed into said interior surface of a respective one of said first sidelong side and said second sidelong side, said card slots in each of said first sidelong side being aligned with a respective one of said card slots in said second sidelong side, said card slots in each of said first sidelong side and said second sidelong side being spaced apart from each other and being distributed along a full length of said first sidelong side and said second sidelong side, said first sidelong side having a first opening extending through said first sidelong side thereby facilitating an interior of said box to be visible through said first opening, said second sidelong having a second opening extending through said second sidelong side thereby facilitating said interior of said box to be visible through said second opening;

a pair of windows, each of said windows being integrated into a respective first sidelong side and said second sidelong side of said outer wall of said box, each of said windows being aligned with a respective one of said first opening and said second opening, each of said windows being comprised of a translucent material thereby facilitating said interior of said box to be visible through said windows;

a lid being hingedly coupled to said box for opening and closing said box, said lid having a top wall and a perimeter wall extending downwardly from said top wall, said perimeter wall having a distal edge with respect to said top wall, said distal edge resting on a top edge of said outer wall of said box when said lid is closed, a top surface of said top wall having a recess extending downwardly in said top surface;

a pair of cushions, each of said cushions being coupled to a respective lower surface of said top wall of said lid and a top surface of a bottom wall of said box, each of said cushions being comprised of a resiliently compressible material for cushioning said card frames when said card frames are stored in said box;

a handle being movably integrated into said recess, said handle being positionable in a stored position having said handle lying in said recess, said handle being positionable in a deployed position having said handle extending upwardly from said recess wherein said handle is configured to be gripped for carrying said box, said handle having a gripping surface, said gripping surface having a plurality of depressions being integrated into said gripping surface wherein each of said depressions is configured to accommodate a user's fingers for enhancing gripping said handle;

a gasket being coupled to said distal edge of said perimeter wall of said lid, said gasket forming a seal with said top edge of said outer wall of said box when said lid is closed; and a latch being hingedly coupled to said outer wall of said box, said latch engaging an engagement on said perimeter wall of said lid when said lid is closed for locking said lid, said latch being releasable from said engagement for opening said lid.

* * * * *